US012291686B2

(12) United States Patent
Kubo et al.

(10) Patent No.: US 12,291,686 B2
(45) Date of Patent: May 6, 2025

(54) LUBRICATING OIL COMPOSITIONS FOR AUTOMATIC TRANSMISSIONS

(71) Applicant: CHEVRON JAPAN LTD., Minato-ku (JP)

(72) Inventors: Koichi Kubo, Kanagawa (JP); Masami Fuchi, Makinohara (JP); Naoya Sasaki, Omaezaki (JP); Takahiro Nakagawa, Omaezaki (JP); Satoshi Ohta, Omaezaki (JP)

(73) Assignee: CHEVRON JAPAN LTD., Minato-Ku (JP)

( * ) Notice: Subject to any disclaimer, the term of this patent is extended or adjusted under 35 U.S.C. 154(b) by 0 days.

(21) Appl. No.: 16/823,946

(22) Filed: Mar. 19, 2020

(65) Prior Publication Data

US 2021/0292676 A1 Sep. 23, 2021

(51) Int. Cl.

| | |
|---|---|
| ***C10M 133/44*** | (2006.01) |
| ***C10M 135/36*** | (2006.01) |
| ***C10M 137/08*** | (2006.01) |
| *C10N 20/02* | (2006.01) |
| *C10N 30/06* | (2006.01) |
| *C10N 30/12* | (2006.01) |
| *C10N 40/04* | (2006.01) |

(52) U.S. Cl.

CPC ..... *C10M 133/44* (2013.01); *C10M 135/36* (2013.01); *C10M 137/08* (2013.01); *C10M 2215/223* (2013.01); *C10M 2219/106* (2013.01); *C10M 2223/043* (2013.01); *C10M 2223/049* (2013.01); *C10N 2020/02* (2013.01); *C10N 2030/06* (2013.01); *C10N 2030/12* (2013.01); *C10N 2040/042* (2020.05)

(58) Field of Classification Search

CPC ..... C10M 2219/106; C10M 2215/223; C10M 2223/041; C10M 2223/043; C10M 2223/047; C10M 2223/049; C10M 169/04; C10M 135/36; C10M 137/08; C10M 133/44; C10M 2223/045; C10M 2223/04; C10M 2201/085; C10N 2040/25; C10N 2030/06; C10N 2030/12; C10N 2010/12; C10N 2040/02; C10N 2010/04; C10N 2040/16; C10N 2020/02; C10N 2010/02; C10N 2030/45; C10N 2040/042; C10N 2030/10

See application file for complete search history.

(56) References Cited

U.S. PATENT DOCUMENTS

| | | | | |
|---|---|---|---|---|
| 6,573,223 | B1 | 6/2003 | Vinci | |
| 7,902,132 | B2 | 3/2011 | Wu et al. | |
| 2006/0240998 | A1 | 10/2006 | Sullivan et al. | |
| 2006/0264341 | A1 | 11/2006 | Culley | |
| 2012/0277134 | A1* | 11/2012 | Deshimaru | C10M 141/10 508/272 |
| 2020/0332218 | A1 | 10/2020 | Susukida et al. | |

FOREIGN PATENT DOCUMENTS

| | | | |
|---|---|---|---|
| EP | 1308496 | A2 | 5/2003 |
| EP | 2520640 | B1 | 4/2016 |
| JP | S59157188 | A | 9/1984 |
| JP | H08165483 | A | 6/1996 |
| JP | 2002003877 | A | 1/2002 |
| JP | 2014237782 | A | 12/2014 |
| JP | 2016190953 | A | 11/2016 |
| JP | 6219799 | B2 | 10/2017 |
| JP | 2018119059 | A | 8/2018 |
| WO | 2011080970 | A1 | 7/2011 |
| WO | 2018139130 | A1 | 8/2018 |

OTHER PUBLICATIONS

PCT International Search Report and Written Opinion, mailed on May 18, 2021, issued in International Application No. PCT/IB2021/052067, filed on Mar. 12, 2021,9 pages.

* cited by examiner

*Primary Examiner* — Vishal V Vasisth

(57) ABSTRACT

The present invention generally relates to lubricating oil compositions useful for automatic transmissions, and particularly transmission oils for automotive automatic transmissions in battery electrical vehicles (BEVs), hybrid vehicles (HVs) and plug-in hybrid vehicles (PHVs). The lubricant is free of metal compounds (e.g., Ca, Mo, or Zn) and demonstrates high volume resistivity, wear protection, and copper corrosion resistance.

6 Claims, No Drawings

LUBRICATING OIL COMPOSITIONS FOR AUTOMATIC TRANSMISSIONS

FIELD OF THE INVENTION

The present invention generally relates to lubricating oil compositions useful for automatic transmissions, and particularly automatic transmissions of electric vehicles (EV).

BACKGROUND OF THE INVENTION

Lubricating oils for automatic transmissions, called automatic transmission fluids, have been used conventionally to assist smooth operation of automatic transmissions which are installed in automobiles and include a torque converter, a gear mechanism, a wet clutch, and a hydraulic mechanism.

Battery electric vehicles (BEVs), hybrid vehicles (HVs), and plug-in hybrid vehicles (PHVs) with electric motors and/or generators built into the transmission present a unique challenge for the lubrication industry. Copper is present in many of the electric systems of the electric vehicle and HVs powertrain and may become corroded at high temperatures. The lubricant in an electric vehicle and HVs, therefore, must provide sufficient copper corrosion protection in order to minimize corrosion.

The volume resistivity (resistance of the fluid to electrical current) can also be an issue. When resistivity is too low, the powertrain will leak charge and lose efficiency. The presence of metal ions decreases the volume resistivity of a fluid. Metals commonly used in lubricants for traditional internal combustion engines, such as Ca, Mo, and Zn, must therefore be minimized in electrical vehicles in order to meet the volume resistivity requirements.

Yet another challenge in BEVs, HVs and PHVs is wear protection. Unlike a traditional vehicle powered by an internal combustion engine, the same lubricating fluid is shared by the electric motor and the transmission in an electric vehicle. The planetary gears used in the transmission system of BEVs, HVs, and PHVs can present challenges with regards to wear protection. While phosphorus- and sulfur-based extreme pressure additives can provide wear protection, sulfur compounds can oxidize to acidic species at high temperatures and contribute to increased corrosion.

Given the complexities associated with lubrication of BEVs, HVs, and PHVs, there exists a need for a lubricant that balances wear protection with good copper corrosion resistance and sufficient volume resistivity.

The disclosed technology relates to a lubricant suitable for use in an electric vehicle, hybrid vehicles, and plug-in hybrid vehicles equipped with electric motors and/or generators built into the transmission. The lubricant is substantially free of metal compounds (e.g., Ca, Mo, or Zn) and demonstrates high volume resistivity, wear protection, and copper corrosion resistance.

SUMMARY OF THE INVENTION

In accordance with one embodiment of the present invention, provided is a lubricating oil composition for battery electrical vehicles (BEVs), hybrid vehicles (HVs) and plug-in hybrid vehicles (PHVs) equipped with electric motors and/or generators comprising:

a. a major amount of an oil of lubricating viscosity having a kinematic viscosity at 100° C. in a range of about 1.5 to about 20 $mm^2/s$;

b. a phosphorus antiwear additive selected from inorganic phosphorus acids, acidic or neutral phosphite esters, acidic or neutral phosphate esters and their amine salts, or combinations thereof;

c. a nitrogen-based corrosion inhibitor, wherein the total amount of nitrogen provided by the corrosion inhibitor to the lubricating oil composition is no more than 125 ppm based of the weight of the lubricating oil composition.

d. a sulfur EP additive, wherein the total amount of sulfur provided by the sulfur EP additive to the lubricating oil composition is 300 to 1500 ppm based of the weight of the lubricating oil composition, wherein the lubricating oil composition contains less than 50 ppm of metals and has a volume resistivity greater than $1.0\times10^9$ Ω·cm at 80° C.

In accordance with another embodiment of the present invention, provided is a method of reducing corrosion and improving wear protection in the transmission systems of battery electrical vehicles (BEVs), hybrid vehicles (HVs) and plug-in hybrid vehicles (PHVs) with electric motors and/or generators comprising lubricating and operating said transmission system with a lubricating oil composition comprising:

a. a major amount of an oil of lubricating viscosity having a kinematic viscosity at 100° C. in a range of about 1.5 to about 20 $mm^2/s$;

b. a phosphorus antiwear additive selected from inorganic phosphorus acids, acidic or neutral phosphite esters, acidic or neutral phosphate esters and their amine salts, or combinations thereof;

c. a nitrogen-based corrosion inhibitor, wherein the total amount of nitrogen provided by the corrosion inhibitor to the lubricating oil composition is no more than 125 ppm based of the weight of the lubricating oil composition.

d. a sulfur EP additive, wherein the total amount of sulfur provided by the sulfur EP additive to the lubricating oil composition is 300 to 1500 ppm based of the weight of the lubricating oil composition, wherein the lubricating oil composition contains less than 50 ppm of metals and has a volume resistivity greater than $1.0\times10^9$ Ω·cm at 80° C.

In accordance with another embodiment of the present invention, provided is the use of a lubricating oil composition for reducing corrosion and improving wear protection in the transmission systems of battery electrical vehicles (BEVs), hybrid vehicles (HVs), and plug-in hybrid vehicles (PHVs) with electric motors and/or generators comprising lubricating and operating said transmission systems with a lubricating oil composition comprising:

a. a major amount of an oil of lubricating viscosity having a kinematic viscosity at 100° C. in a range of about 1.5 to about 20 $mm^2/s$;

b. a phosphorus antiwear additive selected from inorganic phosphorus acids, acidic or neutral phosphite esters, acidic or neutral phosphate esters and their amine salts, or combinations thereof;

c. a nitrogen-based corrosion inhibitor, wherein the total amount of nitrogen provided by the corrosion inhibitor to the lubricating oil composition is no more than 125 ppm based of the weight of the lubricating oil composition.

d. a sulfur EP additive, wherein the total amount of sulfur provided by the sulfur EP additive to the lubricating oil composition is 300 to 1500 ppm based of the weight of the lubricating oil composition, wherein the lubricating oil composition contains less than 50 ppm of metals and has a volume resistivity greater than $1.0\times10^9$ Ω·cm at 80° C.

DETAILED DESCRIPTION OF THE INVENTION

Definitions

The following terms will be used throughout the specification and will have the following meanings unless otherwise indicated.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

The term "substantially free" of metals refers a level of metals that is present at 50 ppm or less than 50 ppm in the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "PIB" refers to poly-isobutylene.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 2nd Edition, London, Springer, Chapters 1 and 2 (1996); and A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a lube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amount of a base oil of lubricating viscosity. In some embodiments, the base oil has a kinematic viscosity at 100° C. from about 1.5 centistokes (cSt) to about 20 cSt, from about 2 centistokes (cSt) to about 20 cSt, or from about 2 cSt to about 16 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

In some embodiments, the base oil comprises one or more of the base stocks in Group I, II, III, IV, V or a combination thereof. In other embodiments, the base oil comprises one or more of the base stocks in Group II, III, IV or a combination thereof. In further embodiments, the base oil comprises one or more of the base stocks in Group II, III, IV or a combination thereof wherein the base oil has a kinematic viscosity from about 1.5 centistokes (cSt) to about 20 cSt, from about 2 cSt to about 20 cSt, or from about 2 cSt to about 16 cSt at 100° C. In some embodiments, the base oil is a Group II baseoil.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 1.5 to about 30, from about 2 to about 20, or from about 2 to about 16 carbon atoms. Non-limiting examples of suitable poly-alpha-olefins include those derived from octene, decene, mixtures thereof, and the like. These poly-alpha-olefins may have a viscosity from about 1.5 to about 15, from about 1.5 to about 12, or from about 1.5 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Phosphorus Additive

In one embodiment, one or more phosphorus-containing antiwear additives are present in the lubricating oil composition.

In some embodiments, one or more phosphorus-containing antiwear additives are present in the lubricating oil composition at from 100 to 1000, from 200 to 500, from 250 to 450, from 275 to 425, from 275 to 415, from 290 to 400 wt ppm, based on the weight of the lubricating oil composition.

The phosphorus additive could be a phosphite ester, a phosphate ester, a phosphate amine, phosphoric acid, or combinations thereof.

(a) Phosphite esters

Phosphite esters include mono, di, and trihydrocarbyl phosphites. Preferred are dihydrocarbyl hydrogen phosphites or trihydrocarbyl phosphites.

In one embodiment, the phosphorus-containing antiwear additive is a dihydrocarbyl hydrogen phosphite. Dihydrocarbyl hydrogen phosphites are represented by the formula (1) below:

$$O{=}P(OR)_2H \qquad \text{Formula (I)}$$

wherein R represents a hydrocarbon group having 1 to 30 carbons.

Specific examples of dihydrocarbyl hydrogen phosphites include aryl dihydrocarbyl hydrogen phosphites such as a diphenyl hydrogen phosphite, dicresyl hydrogen phosphite, phenyl cresyl hydrogen phosphite, a monophenyl 2-ethylhexyl hydrogen phosphite; and aliphatic dihydrocarbyl phosphites such as dibutyl hydrogen phosphite, dioctyl hydrogen phosphite, diisooctyl hydrogen phosphite, di (2-ethylhexyl) hydrogen phosphite, didecyl hydrogen phosphite, diolyel hydrogen phosphite, dilauryl hydrogen phosphite, and distearyl hydrogen phosphite In one embodiment, the phosphorus-containing antiwear additive is a trihydrocarbyl phosphite. Trihydrocarbyl phosphites are represented by the formula (II) below:

$$P(OR)_3 \qquad \text{Formula (II)},$$

wherein R represents a hydrocarbon group having 1 to 30 carbons.

Specific examples of trihydrocarbyl phosphites include aryl trihydrocarbyl phosphites such as a triphenyl phosphite, a tricresyl phosphite, a trisnonyl phenyl phosphite, a diphenylmono-2-ethylhexyl phosphite, and a diphenylmono tridecyl phosphite; and aliphatic trihydrocarbyl phosphites such as a tributyl phosphite, a trioctyl phosphite, a triisooctyl phosphite, a tri (2-ethylhexyl) phosphite, a trisdecyl phosphite, a tristridecyl phosphite, a trioleyl phosphite, a trilaurayl phosphite, and a tristearyl phosphite.

In one embodiment, the phosphite ester is present at from 0.01 to 1.0, 0.05 to 0.8, 0.06 to 0.5, 0.07 to 0.3, 0.07 to 0.2, 0.08 to 0.2, 0.09 to 0.18, 0.09 to 0.16, 0.08 to 0.14, 0.08 to 0.13, 0.09 to 0.12, 0.09 to 0.11, 0.10 wt %, based on the weight of the lubricating oil composition.

In one embodiment, the phosphite ester has a phosphorus content of from 5 to 20, 7 to 18, 9 to 16, 10 to 15, 11 to 14, 12 to 14, 13.3 wt %, based on the weight of the phosphite ester.

(b) Phosphate Amines

Specifically, examples of the phosphate ester amine salt include an amine salt of an acidic alkylphosphate ester represented by the following formula III:

$$(OR)_x(OH)_yP{=}O \qquad \text{[Formula III]},$$

wherein x+y=3 and R represents an alkyl group having 1 to 30 carbons.

Specific examples of alkyl groups represented by R includes a linear or branched alkyl group having 1 to 18, preferably 1 to 12 carbon atoms, and examples thereof include a methyl group, an ethyl group, an n-propyl group, an isopropyl group, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, and various octadecyl groups.

The amine may be a primary amine, a secondary amine, a tertiary amine, or a tertiaty-alkyl primary amine. In addition, examples of the foregoing amine include an amine represented by the general formula:

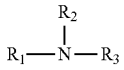

in which R1, R2, and R3 are aliphatic hydrocarbon groups having 1 to 20 carbon atoms or a hydrogen atom, and at least one of R1, R2, and R3 is an aliphatic hydrocarbon group having 1 to 20 carbon atoms. Here, the aliphatic hydrocarbon group is preferably an alkyl group or an unsaturated hydrocarbon group having 1 to 2 unsaturated double bonds, and the alkyl group and the unsaturated hydrocarbon group may be each any of straight-chain, branched, and cyclic groups. The aforementioned aliphatic hydrocarbon group is preferably one having 6 to 20 carbon atoms, and more preferably one having 12 to 20 carbon atoms. The amine is still more preferably a primary amine in which the aliphatic hydrocarbon group has 12 to 20 carbon atoms.

In one embodiment, the alky phosphate amine salt is present at from 0.01 to 1.0 wt. % of the lubricating oil composition. In other embodiments, the alky phosphate amine salt is present at from 0.01 to 0.5 wt. %, from 0.05 to 0.25 wt. %, from 0.06 to 0.25 wt. %, 0.07 to 0.20 wt. %, 0.08 to 0.19 wt. %, 0.08 to 0.18 wt. %, 0.09 to 0.17, 0.09 to 0.16, 0.1 to 0.15 wt. %, in the lubricating oil composition.

In one embodiment, the phosphate amine has a phosphorus content of from 2.0 to 12.0 wt. %. In other embodiments, the phosphorus additive has a phosphorus content of from 5.0 to 11.0 wt. %, 6.0 to 10.0 wt. %, 7.0 to 10.0 wt. %, 7.5 to 9.5 wt. %, 7.8 to 9.0 wt. %, 8.0 to 8.5 wt. %.

In one embodiment, the phosphate amine salt has a total nitrogen content of from 0.10 to 5.0 wt. %. In other embodiments, the phosphate amine salt has a nitrogen content of from 0.50 to 4.0 wt. %, 0.70 to 3.0 wt. %, 0.9 to 2.5 wt. %, 1.0 to 2.3 wt. %, 1.2 to 2.2 wt. %, 0.15 to 2.0 wt. %, 1.6 to 1.9 wt. %.

(c) Phosphoric Acid

The phosphoric acid is an inorganic phosphoric acid of the formula (IV) $H_3PO_4$. The inorganic phosphoric acid is present at from 0.01 to 0.09 wt %, from 0.02 to 0.08 wt %, from 0.02 to 0.07 wt %, from 0.02 to 0.06 wt %, from 0.025 to 0.055 wt %, from 0.03 to 0.05 wt % in the lubricating oil composition.

Sulfur-Based Extreme Pressure (EP) Additives

The lubricating oil composition disclosed herein comprise an extreme pressure (EP) agents which can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Examples of the sulfur-based extreme pressure agents include sulfurized oils and fats, sulfurized fatty acids, sulfurized esters, sulfurized olefins dihydrocarbyl polysulfides, thiadiazole compounds, thiophosphoric esters (thiophosphites and thiophosphates), alkylthiocarbamoyl compounds thiocarbamate compounds, thioterpene compounds and dialkylthiodipropionate compounds.

In one embodiment, the sulfur-based extreme pressure additives are thiadiazole compounds. Thiadiazole compounds, in particular, provide good resistance to wear between metal-to-metal surfaces. Preferably, thiadiazole compounds such as 1,3,4-thiadiazoles, 1,2,4-thiadiazole compounds, and 1,4,5-thiadiazoles are preferred.

In one embodiment, the thiadiazole compounds are the 1,3,4-thiadiazoles, especially 2,5-bis(hydrocarbyldithio)-1,3,4-thiadiazole which is exemplified by the following formula V:

Formula V

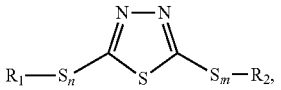

In the structure above, R1 and R2 each represent an alkyl group having 1 to 30 carbon atoms, preferably 6 to 18 carbon atoms. The alkyl group may be linear or branched. R1 and R2 may be mutually the same or different.

Specific examples of the alkyl group represented by R1 and R2 in the general structure above include a methyl group, an ethyl group, an n-propyl group, an isopropyl group, an n-butyl group, an isobutyl group, a sec-butyl group, a tert-butyl group, various pentyl groups, various hexyl groups, various heptyl groups, various octyl groups, various nonyl groups, various decyl groups, various undecyl groups, various dodecyl groups, a tridecyl group, a tetradecyl group, a pentadecyl group, a hexadecyl group, a heptadecyl group, an octadecyl group, a nonadecyl group, and an eicosyl group.

In one embodiment, the amount of the sulfur-based extreme pressure additives can be from about 0.01 wt. % to about 3 wt. %, from about 0.05 wt. % to about 1.5 wt. %, 0.05 wt. % to about 1.5 wt. %, 0.05 wt. % to about 1.0 wt. %, 0.05 wt. % to about 0.75 wt. %, 0.05 wt. % to about 0.5 wt. %, or from about 0.08 wt. % to about 1.0 wt. %, 0.08 wt. % to about 0.7 wt. %, 0.08 wt. % to about 0.6 wt. %, 0.08 wt. % to about 0.5 wt. %, 0.09 wt. % to about 0.8 wt. %, based on the total weight of the lubricating oil composition.

In one embodiment, the amount of sulfur from the sulfur-based extreme pressure additives is from 300 to 1500, from 300 to 1400, from 300 to 1300, from 300 to 1200, 300 to 1100, 300 to 1050 wt. ppm based on the total weight of the lubricating oil composition.

Corrosion Inhibitor

The lubricating oil composition disclosed herein comprise a corrosion inhibitor which can reduce corrosion. The corrosion inhibitor can be a nitrogen-containing heterocyclic compound and derivatives thereof. In an embodiment, the triazole of the present disclosure is one in which it does not include any active sulfur groups. Alkyl and aryl derivatives of triazoles are preferred. Most preferred is tolyltriazole. These can be substituted or unsubstituted. The tolyltriazole compound of the present invention is exemplified by the following formula VI:

Formula VI

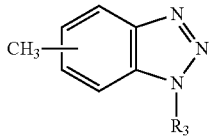

In the above formula, R3 is represents a hydrogen or an alkyl group having 1 to 30 carbons. R3 may be linear or branched, it may be saturated or unsaturated. It may contain ring structures that are alkyl or aromatic in nature. R3 may also contain heteroatoms such as N, O or S.

The substituted triazole of the invention may be prepared by condensing a basic triazole via its acidic —NH group with an aldehyde and an amine. In some embodiments, the substituted triazole is the reaction product of a triazole, an aldehyde and an amine. Suitable triazoles that may be used to prepare the substituted triazole of the disclosure include triazole, alkyl substituted triazole, benzotriazole, tolyltriazole, or other aryltriazoles while suitable aldehydes include formaldehyde and reactive equivalents like formalin, while suitable amines include primary or secondary amines. In some embodiments, the amines are secondary amines and further are branched amines. In still further embodiments the amines are beta branched amines, for examples bis-2-ethylhexyl amine.

In one embodiment, the substituted triazole of the invention is alkyl substituted triazole. In another embodiment, the substituted triazole of the invention is benzotriazole. The lubricating oil compositions of the disclosure typically include the triazole from about 0.01 to about 1.0 percent by weight, but may also include from about 0.02 to 0.08, 0.02 to 0.07, 0.02 to 0.06, 0.02 to about 0.05, 0.03 to about 0.05 percent by weight of the triazole compound.

In one embodiment, the corrosion inhibitor is present at no more than 125 wt. ppm based on the weight of the lubricating oil composition. In other embodiments, the corrosion inhibitor is present from 20 to 125, from 25 to 110, 30 to 105, 35 to 100, 40 to 100, 43 to 95 wt. ppm based on the weight the lubricating oil composition.

Other Additives

Optionally, the lubricating oil composition may further comprise at least an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of antioxidants, anti-wear agents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. In general, the concentration of each of the additives in the lubricating oil composition, when used, may range from about 0.001 wt. % to about 15 wt. %, from about 0.01 wt. % to about 10 wt. %, or from about 0.1 wt. % to about 8 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 8 wt. %, based on the total weight of the lubricating oil composition.

The lubricating oil compositions disclosed herein are substantially free of metals (i.e., containing less than 50 ppm of metals). The presence of polar or ionic compounds has been shown to increase the conductivity (and thereby decrease the volume resistivity) of transmission fluids in Newcomb, T., et al, "Electrical Conductivity of New and Used Automatic Transmission Fluids," SAE Int. J. Fuels Lubr. 9(3):2016, doi:10.4271/2016-01-2205. In particular, metal-containing additives such as detergents negatively impact the volume resistivity of the lubricating oil composition and therefore should be minimized, although the presence of dispersants, friction modifiers, and wear inhibitors contribute to increased conductivity of the bulk fluid as well.

The above optional additives, in addition to being ashless (metal-free), are chosen such that the volume resistivity of the lubricating oil composition is greater than $1.0\times10^9$ Ω·cm. A sufficiently high volume resistivity is necessary to provide adequate insulating properties in the lubricating oil composition.

The lubricating oil composition of the present invention can contain one or more ashless dispersants. Typically, the ashless dispersants are nitrogen-containing dispersants formed by reacting alkenyl succinic anhydride with an amine. Examples of such dispersants are alkenyl succinimides and succinamides. These dispersants can be further modified by reaction with, for example, boron or ethylene carbonate. Ester-based ashless dispersants derived from long chain hydrocarbon-substituted carboxylic acids and hydroxy compounds may also be employed. Preferred ashless dispersants are those derived from polyisobutenyl succinic anhydride. These dispersants are commercially available.

Optionally, the lubricating oil composition disclosed herein can further comprise a friction modifier. A variety of known friction modifiers can be used as the friction modifier contained in the lubricating oil composition of the present invention, but a low molecular weight $C_6$ to $C_{30}$ hydrocarbon-substituted succinimide, or a polyol is preferable. The friction modifier can be used singly or as a combination of friction modifiers. In some aspects, the friction modifier is present in an amount of from 0.01 to 5 wt. % in the lubricating oil composition. In other aspects, the friction modifier is present in an amount of from 0.01 to 3.0, from 0.01 to 2.0 wt. %, from 0.01 to 1.5, from 0.01 to 1.0, from 0.01 to 1.0, in the lubricating oil composition Optionally, the lubricating oil composition disclosed herein can further comprise an antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "*Chemistry and Technology of Lubricants,*" 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.0001 wt. % to about 1 wt. %, from about 0.0005 wt. % to about 0.5 wt. %, or from about 0.001 wt. % to about 0.1 wt. %, based on the total weight of the lubricating oil composition. Some suitable anti-foams have been described in Mortier et al., "*Chemistry and Technology of Lubricants,*" 2nd Edition, London, Springer, The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

In certain embodiments, the lubricating oil composition comprises at least a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Generally, it is desired that the diluent readily solubilizes the lubricating oil soluble additive of the invention and provides an oil additive concentrate that is readily soluble in the lubricant base oil stocks or fuels. In addition, it is desired that the diluent not introduce any undesirable characteristics, including, for example, high volatility, high viscosity, and impurities such as heteroatoms, to the lubricant base oil stocks and thus, ultimately to the finished lubricant or fuel.

The present invention further provides an oil soluble additive concentrate composition comprising an inert diluent and from 2.0% to 90% by weight, preferably 10% to 50% by weight based on the total concentrate, of an oil soluble additive composition according to the present invention.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

The following non-limiting examples are illustrative of the present invention.

The lubricating oil compositions for evaluating their performances were prepared from the below-mentioned additives.

Comparative lubricating oil compositions (C-1 through C-9) and Inventive Examples (I-1 through I-8) were prepared from the below-mentioned additives in the amounts (wt. %) described in Table 2. R-1 is a commercially available Dexron-VI ATF package and R-2 is a commercially available Ford Mercon ATF package, and therefore their exact contents and ratios are unknown.

Phosphite ester is an aryl phosphite (P: 13.3 wt %)

Phosphoric acid is an inorganic phosphoric acid (P: 27 wt %)

Phosphorus additive is an alkyl phosphate amine salt (P: 8.2 wt %, N: 1.8 wt %)

Sulfur EP additive A is a branched dialkyl thiadiazole compound (S: 34.0 wt %, N: 6.0 wt %)

Sulfur EP additive B is a linear dialkyl thiadiazole compound (S: 31.0 wt %, N: 4.5 wt %)

Corrosion inhibitor A is an alkylated benzotriazole compound (N: 14.6 wt %)

Corrosion inhibitor B is a benzotriazole compound (N: 31.6 wt %)

Other additives are dispersants, friction modifiers, antioxidants, seal swell agents, and foam inhibitors.

Wear Scar Test

The antiwear performance of each lubricating oil compositions was determined in accordance with the 4 ball wear scar test ASTM D4172 under conditions of 1800 rpm, oil temperature of 80° C., and a load of 392N for 60 min. After testing, the test balls were removed and the wear scars were measured. The wear scar diameters are reported in mm in Table 1. Specifically, when the wear scar diameter is equal to or smaller than 0.55 mm, the sample oil exhibits favorable wear performance.

Extreme Pressure Wear Test

The extreme pressure wear performance of the lubricating oil compositions was determined using the Falex Pin and Vee Block Test (ASTM D3233, Method B, Pin material: SAE 3135 steel, Block: AISI-C-1137 steel). This method comprises running a rotating steel journal at 290 rpm against two stationary V-blocks immersed in the lubricant sample. Load is applied to the V-blocks by a ratchet mechanism. In Test Method B, load is applied in 250-lbf (1112-N) increments with load maintained constant for 1 min at each load increment. The fail load value obtained is the criteria for the level of load-carrying properties. Specifically, when the failure load is equal to or greater than 1000 lbs, the sample oil exhibits favorable wear performance.

Cu Corrosion Test

The Cu corrosion resistance of the lubricating oil compositions was determined using the Indiana Stirring Oxidation Test (ISOT, Test method JIS K 2514 Two catalyst plates (copper and steel) and a glass varnish rod are immersed in test oil, and the test oil is heated to 165.5° C. and aerated by stirring for 150 hours. The increase in Cu content of the test oils is measured and reported in ppm in Table 1. Specifically, when Cu content of the oil is 50 ppm or less, the sample oil exhibits favorable anti-corrosion performance. Additionally, the appearance of sludge or varnish formation is indicative of poor oxidative corrosion performance.

Volume Resistivity

The electrical insulating ability of the lubricating oil compositions was determined in accordance with JIS C2101-1999-24. The volume resistivity of the test oils at 80° C. and an applied voltage of 250V was measured and is reported in units of Ω·cm. A volume resistivity of $1.0\times10^{9}$ Ω·cm or greater is sufficiently high for electric vehicle applications.

TABLE 2

| Examples | C-1 | C-2 | C-3 | C-4 | C-5 | C-6 | C-7 | I-1 | I-2 |
|---|---|---|---|---|---|---|---|---|---|
| Phosphite ester | | | 0.1 | 0.1 | 0.1 | 0.1 | 0.1 | 0.1 | 0.1 |
| Phosphoric acid | | | | 0.05 | 0.05 | 0.05 | 0.05 | 0.05 | 0.05 |
| Phosphate amine | | | | | 0.15 | 0.15 | 0.15 | 0.15 | 0.15 |
| Sulfur EP additive A | | | | | | | | 0.1 | |
| Sulfur EP additive B | | | | | | 0.1 | | | 0.1 |
| Corr. Inhib. A | | | | | | | | 0.03 | 0.03 |
| Corr. Inhib. B | | | | | | | 0.03 | | |
| Viscosity Index Modifier | | | | | | | | | |
| Other additives | | | 4.07 | 4.07 | 4.07 | 4.07 | 4.07 | 4.07 | 4.07 |
| Gp II base oil | | | | | | | | | |
| Gp III base oil | | | | | | | | | |
| Gp IV base oil | | | | Bal. | Bal. | Bal. | Bal. | Bal. | Bal. |
| Gp V base oil | | | | | | | | | |
| Total P (ppm) | | | 130 | 270 | 390 | 390 | 390 | 390 | 390 |
| S from Sulfur EP additive A and B (ppm) | 0 | 0 | 0 | 0 | 0 | 310 | 0 | 340 | 310 |
| N from corr. Inh. A and B (ppm) | 0 | 0 | 0 | 0 | 0 | 0 | 95 | 44 | 44 |
| 4 ball wear scar diameter (mm) | 0.65 | 0.63 | 1.88 | 1.90 | 0.59 | 0.49 | 0.69 | 0.44 | 0.45 |
| Falex pin and vee block test (failure load) | 850 | 850 | 850 | 850 | 1000 | 1050 | 1250 | 1350 | 1250 |
| Oxidative corrosion test (ppm Cu) | 102 | 69 | 47 | 26 | 57 | 483 | 19 | 13 | 46 |
| Volume resistivity @ 80° C. (×10^9 Ω · cm) | 1.8 | 2.1 | 3.0 | 3.0 | 1.7 | 1.8 | 1.8 | 1.7 | 1.7 |

| Examples | I-3 | I-4 | I-5 | I-6 | I-7 | 1-8 | 1-9 | C-8 | C-9 |
|---|---|---|---|---|---|---|---|---|---|
| Phosphite ester | 0.1 | 0.1 | 0.1 | 0.1 | 0.1 | 0.1 | 0.1 | 0.1 | 0.1 |
| Phosphoric acid | 0.05 | 0.05 | 0.05 | 0.05 | 0.05 | 0.05 | 0.03 | 0.05 | 0.05 |
| Phosphate amine | 0.15 | 0.15 | 0.15 | 0.15 | 0.15 | 0.15 | 0.10 | 0.15 | 0.15 |
| Sulfur EP additive A | | | 0.2 | 0.3 | 0.1 | 0.1 | 0.15 | 0.3 | 0.5 |
| Sulfur EP additive B | 0.1 | 0.1 | | | | | | | |
| Corr. Inhib. A | 0.05 | | 0.03 | 0.03 | 0.03 | 0.03 | 0.03 | | 0.03 |
| Corr. Inhib. B | | 0.03 | | | | | | 0.05 | |
| Viscosity Index Modifier | | | | | 5.1 | 0.1 | | | |
| Other additives | 4.07 | 4.07 | 4.07 | 4.07 | 4.07 | 4.07 | 3.67 | 4.07 | 4.07 |
| Gp II base oil | | | | | 50 | 81.4 | | | |
| Gp III base oil | | | | | 35.4 | | | | |
| Gp IV base oil | Bal. | Bal. | Bal. | Bal. | Bal. | 9 | Bal. | Bal. | Bal. |
| Gp V base oil | | | | | 5 | 5 | | | |
| Total P (ppm) | 390 | 390 | 390 | 390 | 390 | 390 | 300 | 390 | 390 |
| S from Sulfur EP additive A and B (ppm) | 310 | 310 | 680 | 1020 | 340 | 340 | 510 | 1020 | 1700 |
| N from corr. Inh. A and B (ppm) | 73 | 95 | 44 | 44 | 44 | 44 | 44 | 158 | 44 |
| 4 ball wear scar diameter (mm) | 0.50 | 0.46 | 0.45 | 0.47 | 0.50 | 0.54 | 0.45 | 0.47 | 0.47 |
| Falex pin and vee block test (failure load) | 1200 | 1100 | 1300 | 1350 | 1350 | 1400 | 1150 | 800 | 1350 |

TABLE 2-continued

| | | | | | | | | | |
|---|---|---|---|---|---|---|---|---|---|
| Oxidative corrosion test (ppm Cu) | 31 | 32 | 19 | 11 | 20 | 24 | 14 | 25 | 43* |
| Volume resistivity @ 80° C. (×10^9 Ω · cm) | 1.6 | 1.7 | 1.8 | 1.7 | 1.7 | 1.5 | 2.6 | 1.5 | 1.4 |

*Test oil showed black deposits on Cu catalyst surface and precipitation in test cell, indicating poor oxidative corrosion performance.
Note:
(1) Composition is in (wt %); and (2) Bal. means Balance

Evaluation of the Test Oils

Comparative examples C-3 and C-4 demonstrate that the use of phosphite antiwear additives with or without phosphoric acid, respectively, does not provide sufficient antiwear performance as evidenced by the poor wear results. C-5 shows that the addition of phosphate amine improves the antiwear and extreme pressure performance somewhat, but is still insufficient. The addition of a sulfur EP additive in C-6 results in good wear and EP performance, but is detrimental to copper corrosion performance as evidenced by the high level of Cu corrosion (483 ppm Cu). On the other hand, C-7 shows that the corrosion inhibitor alone gives good Cu corrosion results but is insufficient to achieve sufficient wear performance.

Inventive examples I-1 through I-8 demonstrate that balancing sulfur antiwear additive with corrosion inhibitor is critical to achieving both superior antiwear performance and controlling Cu corrosion. Inventive examples I-7 and I-8, formulated using a mixture of Gp II and Gp III base oils, provided adequate wear and corrosion protection as well.

Inventive example I-9 was formulated with a lower treat rate of phosphorus additives and dispersant to demonstrate the effect on volume resistivity. As shown in Newcomb, T., "Electrical Conductivity of New and Used Automatic Transmission Fluids," SAE Int. J. Fuels Lubr. 9(3):2016, doi: 10.4271/2016-01-2205, metal-containing detergents have the greatest impact on the electrical conductivity of the bulk fluid, but other additives such as small molecule antiwear additives and dispersants also impact the volume resistivity. Inventive example I-9 demonstrates that lowering the amount of such polar additives can increase the volume resistivity of the lubricating composition, while still maintaining good antiwear and copper corrosion protection.

Comparative examples C-8 and C-9 were formulated to determine the maximum threshold of corrosion inhibitor and sulfur EP additive that can be tolerated, respectively. C-8 illustrates that overtreating the corrosion inhibitor leads to poor antiwear performance. C-9 shows that at 1700 ppm of sulfur, black deposits formed on the surface of the Cu strip and in the test cell and is indicative of severe corrosion.

To better understand the effect of ionic contaminants on the volume resistivity of the lubricating composition, inventive example I-9 was modified with the addition of small amounts of metal-containing additives. Calcium detergent, Molybdenum-containing friction modifier, and ZnDTP antiwear additive was added in comparative examples I-10, I-11, and I-12 respectively. The concentration of Ca, Mo, and Zn in I-10, I-11, and I-12 were all approximately 50 ppm.

TABLE 3

| Composition (wt %) | I-9 | I-10 | I-11 | I-12 |
|---|---|---|---|---|
| Phosphite ester | 0.1 | 0.1 | 0.1 | 0.1 |
| Phosphoric acid | 0.03 | 0.03 | 0.03 | 0.03 |

TABLE 3-continued

| Composition (wt %) | I-9 | I-10 | I-11 | I-12 |
|---|---|---|---|---|
| Phosphate amine | 0.10 | 0.10 | 0.10 | 0.10 |
| Sulfur EP additive A | 0.15 | 0.15 | 0.15 | 0.15 |
| Corr. Inhib. A | 0.03 | 0.03 | 0.03 | 0.03 |
| Other additives | 3.67 | 3.67 | 3.67 | 3.67 |
| Gp IV base oil | Balance | Balance | Balance | Balance |
| Ca detergent (16.0 wt % Ca) | 0 | 0.03 | | |
| Mo FM (10.0 wt % Mo) | 0 | | 0.05 | |
| ZnDTP (7.85 wt % Zn) | 0 | | | 0.06 |
| Water | 0 | | | |
| Volume resistivity @ 80° C. (× 10^9 Ω · cm) | 2.6 | 2.2 | 2.2 | 2.2 |

Examples I-10 through I-12 demonstrate that the presence of 50 ppm of metals in the lubricating oil composition only has a slight impact on the volume resistivity. Even with 50 ppm of metal contamination, the volume resistivity of example oils I-10 through I-12 remain above $1.0\times10^9$ Ω·cm at 80° C. These examples illustrate that a small amount of metal contamination can be tolerated without drastically impacting the volume resistivity It will be understood that various modifications may be made to the embodiments disclosed herein. Therefore, the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition for battery electrical vehicles (BEVs), hybrid vehicles (HVs) and plug-in hybrid vehicles (PHVs) with electric motors and/or generators comprising:

a. at least 50 wt. % of an oil of lubricating viscosity having a kinematic viscosity at 100° C. in a range of about 1.5 to about 20 mm 2/s;

b. total of 300 to 390 ppm of phosphorus from aryl phosphite, inorganic phosphoric acid, and alkyl phosphate amine salt;

c. a nitrogen-based corrosion inhibitor, wherein the total amount of nitrogen provided by the corrosion inhibitor to the lubricating oil composition is 40 to 100 ppm based on the weight of the lubricating oil composition, wherein the nitrogen-based corrosion inhibitor is alkylated benzotriazole compound or benzotriazole compound;

d. a sulfur EP additive, wherein the total amount of sulfur provided by the sulfur EP additive to the lubricating oil composition is 300 to 1050 ppm based of the weight of the lubricating oil composition, wherein the sulfur EP additive is branched dialkyl thiadiazole compound or linear dialkyl thiadiazole compound;

wherein the lubricating oil composition contains less than 50 ppm of metals and has a volume resistivity greater than 1.0×10 9 Ω·cm at 80° C.

2. The lubricating oil composition of claim 1, wherein the corrosion inhibitor has the following structure:

(VI)

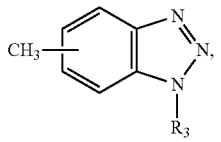

wherein $R_3$ is a hydrogen or a hydrocarbyl group comprising 1 to 20 carbon atoms which optionally contain an oxygen, sulfur, or nitrogen atom.

3. The lubricating oil composition of claim 1, wherein the sulfur EP additive has the following structure:

(V)

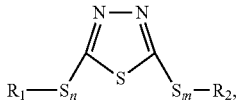

wherein $R_1$ and $R_2$ are each independently hydrogen atom or a hydrocarbyl moiety comprising 6 to 18 carbon atoms, m is 2, and n=2.

4. A method of reducing corrosion and improving wear protection in the transmission systems of battery electrical vehicles (BEVs), hybrid vehicles (HVs) and plug-in hybrid vehicles (PHVs) with electric motors and/or generators comprising lubricating and operating said transmission system with a lubricating oil composition comprising:

a. at least 50 wt % of an oil of lubricating viscosity having a kinematic viscosity at 100° C. in a range of about 1.5 to about 20 $mm^2/s$;

b. total of 300 to 390 ppm of phosphorus from aryl phosphite, inorganic phosphoric acid, and alkyl phosphate amine salt;

c. a nitrogen-based corrosion inhibitor, wherein the total amount of nitrogen provided by the corrosion inhibitor to the lubricating oil composition is 40 to 100 ppm based of the weight of the lubricating oil composition, wherein the nitrogen-based corrosion inhibitor is alkylated benzotriazole compound or benzotriazole compound;

d. a sulfur EP additive, wherein the total amount of sulfur provided by the sulfur EP additive to the lubricating oil composition is 300 to 1050 ppm based on the weight of the lubricating oil composition, wherein the sulfur EP additive is branched dialkyl thiadiazole compound or linear dialkyl thiadiazole compound;

wherein the lubricating oil composition contains less than 50 ppm of metals and has a volume resistivity greater than $1.0\times10^9$ Ω·cm at 80° C.

5. The method of claim 4, wherein the corrosion inhibitor has the following structure:

(VI)

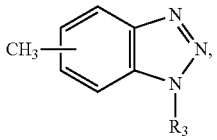

wherein $R_3$ is a hydrogen or a hydrocarbyl group comprising 1 to 20 carbon atoms which optionally contain an oxygen, sulfur, or nitrogen atom.

6. The method of claim 4, wherein the sulfur EP additive has the following structure:

(V)

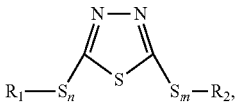

wherein $R_1$ and $R_2$ are each independently hydrogen atom or a hydrocarbyl moiety comprising 6 to 18 carbon atoms, m is 2, and n=2.

* * * * *